US009827646B2

(12) United States Patent
Kim et al.

(10) Patent No.: US 9,827,646 B2
(45) Date of Patent: Nov. 28, 2017

(54) POLISHING PAD AND PREPARING METHOD THEREOF

(71) Applicant: FNS Tech. Co., Ltd., Cheonan-si (KR)

(72) Inventors: Pal-Kon Kim, Cheonan-si (KR); Seung-Taek Oh, Cheonan-si (KR)

(73) Assignee: FNS Tech Co., Ltd., Cheonan-si (KR)

( * ) Notice: Subject to any disclaimer, the term of this patent is extended or adjusted under 35 U.S.C. 154(b) by 0 days.

(21) Appl. No.: 15/158,920

(22) Filed: May 19, 2016

(65) Prior Publication Data

US 2016/0339559 A1 Nov. 24, 2016

(30) Foreign Application Priority Data

May 20, 2015 (KR) ..... 10-2015-0070674

(51) Int. Cl.
*B24B 1/00* (2006.01)
*B24D 3/00* (2006.01)
*B24B 37/24* (2012.01)

(52) U.S. Cl.
CPC ..... *B24B 37/24* (2013.01)

(58) Field of Classification Search
None
See application file for complete search history.

(56) References Cited

U.S. PATENT DOCUMENTS 3,694,301 A * 9/1972 Gruenewald ..... C08G 18/4833 156/148
2002/0077036 A1* 6/2002 Roberts ..... B24B 37/26 451/41
2004/0053007 A1* 3/2004 Huh ..... B24B 37/205 428/158
2009/0212454 A1* 8/2009 Smith ..... A61L 15/26 264/45.1
2010/0247868 A1 9/2010 Cha et al.
2011/0183583 A1* 7/2011 Joseph ..... B24B 37/22 451/41
2012/0315830 A1* 12/2012 Joseph ..... B24B 37/26 451/59
2013/0012106 A1* 1/2013 Kazuno ..... B24B 37/24 451/41
2013/0012108 A1* 1/2013 Li ..... B24D 3/344 451/59
2013/0102231 A1* 4/2013 Joseph ..... B24B 37/22 451/59

FOREIGN PATENT DOCUMENTS

| | | | |
|---|---|---|---|
| CN | 1513008 | A | 7/2004 |
| CN | 1610962 | A | 4/2005 |
| CN | 1980967 | A | 6/2007 |
| JP | S5941501 | A | 3/1984 |
| JP | 2002013445 | A | 1/2002 |
| JP | 2002018731 | A | 1/2002 |
| JP | 2010058194 | A | 3/2010 |
| KR | 10-2010-0106841 | A | 10/2010 |
| KR | 10-2012-0039531 | A | 4/2012 |

* cited by examiner

*Primary Examiner* — Kaj K Olsen
*Assistant Examiner* — Ross J Christie
(74) *Attorney, Agent, or Firm* — Fox Rothschild LLP

(57) ABSTRACT

The present disclosure relates to a porous polishing pad including pores by carbon dioxide gas generated by a reaction between a prepolymer and a hydrophilic polymer, and a method of preparing the porous polishing pad.

9 Claims, No Drawings

POLISHING PAD AND PREPARING METHOD THEREOF

CROSS-REFERENCE TO RELATED APPLICATION

This application clams the benefit of Korean Patent Application No 10-2015-0070674 filed on May 20, 2015, the disclosures of which are incorporated herein by reference.

TECHNICAL FIELD

The present disclosure relates to a porous polishing pad including pores by carbon dioxide gas generated by a reaction between a prepolymer and a hydrophilic polymer material, and a method of preparing the porous polishing pad.

BACKGROUND

Semiconductor devices are formed from a flat, thin wafer of a semiconductor material such as silicon. The wafer needs to be polished to have a sufficiently flat surface with no or minimal defects. Various chemical, electrochemical, and chemical mechanical polishing techniques are employed to polish the wafers. For many years, optical lenses and semiconductor wafers have been polished by a chemical mechanical means. In particular, with the rapid advancement in the field of semiconductor technology, very large scale integrated (VLSI) and ultra large scale integrated (ULSI) circuits have been developed. Accordingly, more elements can be integrated in a smaller area within a semiconductor substrate. As the density of the elements is increased, a higher flatness is required.

In chemical mechanical polishing (CMP), a polishing pad prepared from a urethane material has been used together with a slurry to polish the wafers. The slurry includes polishing particles, such as aluminum oxide, cerium oxide or silica particles, dispersed in an aqueous medium. The polishing particles generally range in size from 100 nm to 200 nm. The slurry further includes other agents such as surface acting agents, oxidizing agents, or pH controlling agents. The urethane pad is weaved to have channels or perforations helpful in distributing the slurry across the pad and the wafer and removing the slurry and slurry fragments. In one type of polishing pad, hollow, spherical microelements are distributed throughout the urethane material. As the surface of the pad is worn away through use, the microelements provide a continually renewable surface texture.

Meanwhile, copper has been increasingly used as a connection material due to its low resistance. Typically, an etching technique is employed to flatten conductive (metal) and insulating surfaces. In this regard, the CMP process causes many defects during polishing of a low-k material and a copper wire. If the low-k material is used for a copper inlay technique and the CMP process is performed, the low-k material may be deformed or damaged under a high mechanical pressure, so that a local defect may be formed in a substrate surface. Further, during polishing of the copper wire, a local defect such as dishing of the copper wire and erosion of a dielectric layer caused by overpolishing of the substrate surface may be formed. Furthermore, another layer such as a barrier layer may be removed in a non-uniform manner.

Korean Patent No. 10-1109376 provides a chemical mechanical polishing pad including open cells.

SUMMARY

The present disclosure provides a method of preparing a porous polishing pad, including: adding a hydrophilic polymer material in a prepolymer; and generating carbon dioxide by a reaction between the prepolymer and the hydrophilic polymer material to form pores in the prepolymer.

Further, the present disclosure provides a porous polishing pad including carbon dioxide pores.

However, problems to be solved by the present disclosure are not limited to the above-described problems. Although not described herein, other problems to be solved by the present disclosure can be clearly understood by those skilled in the art from the following descriptions.

In accordance with a first aspect of the present disclosure, there is provided a method of preparing a porous polishing pad, including: adding a hydrophilic polymer material in a prepolymer; and generating carbon dioxide by a reaction between the prepolymer and the hydrophilic polymer material to form pores in the prepolymer.

In accordance with a second aspect of the present disclosure, there is provided a porous polishing pad including carbon dioxide pores and being prepared according to the first aspect of the present disclosure.

According to an embodiment of the present disclosure, it is possible to form pores in a polishing pad by generating carbon dioxide using a prepolymer and a hydrophilic polymer material during a preparing process of a porous polishing pad.

Conventionally, physical foaming agents or chemical foaming agents have been used to form pores in a pad during a preparing process of a porous polishing pad. Particularly, if a porous polishing pad prepared using a physical foaming agent is used in a chemical mechanical polishing process, the physical foaming agent remains on the pad and thus causes damage to a wafer.

However, according to the method of preparing a polishing pad in accordance with an embodiment of the present disclosure, when a porous polishing pad is prepared, the hydrophilic polymer material is used to form pores instead of a physical foaming agent. Thus, a polishing rate becomes uniform and a surface quality of a polishing target is improved. Particularly, the hydrophilic polymer material used to form pores in the method of preparing the present disclosure is dissolved in a slurry or distilled water during a chemical mechanical polishing process and thus does not remain on the pad. Therefore, the hydrophilic polymer material does not damage the polishing target.

Further, when carbon dioxide is generated by the reaction between the prepolymer and the hydrophilic polymer material in accordance with an embodiment of the present disclosure, the reaction between the prepolymer and the hydrophilic polymer material can be controlled by regulating a temperature of the reaction, a stirring speed, a stirring time, and the like to regulate generation of the carbon dioxide. Therefore, it is possible to easily control a pore size and porosity of the porous polishing pad.

The foregoing summary is illustrative only and is not intended to be in any way limiting. in addition to the illustrative aspects, embodiments, and features described above, further aspects, embodiments, and features will become apparent by reference to the drawings and the following detailed description.

DETAILED DESCRIPTION

Hereinafter, embodiments and examples of the present disclosure will be described in detail so that the present disclosure may be readily implemented by those skilled in the art.

However, it is to be noted that the present disclosure is not limited to the embodiments and examples but can be embodied in various other ways.

Through the whole document, the term "connected to" or "coupled to" that is used to designate a connection or coupling of one element to another element includes both a case that an element is "directly connected or coupled to" another element and a case that an element is "electronically connected or coupled to" another element via still another element.

Through the whole document, the term "on" that is used to designate a position of one element with respect to another element includes both a case that the one element is adjacent to the another element and a case that any other element exists between these two elements.

Through the whole document, the term "comprises or includes" and/or "comprising or including" used in the document means that one or more other components, steps, operation and/or existence or addition of elements are not excluded addition to the described components, steps, operation and/or elements unless context dictates otherwise.

The term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party. Through the document, the term "step of" does not mean "step for".

Through the whole document, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Through the whole document, a phrase in the form "A and/or B" means "A, B, or A and B".

Hereinafter, a method of preparing a pad according to the present disclosure will be described in detail with reference to embodiments and examples. However, the present disclosure may not be limited to the following embodiments and examples.

In accordance with a first aspect of the present disclosure, there is provided a method of preparing a porous polishing pad, including: adding a hydrophilic polymer material in a prepolymer; and generating carbon dioxide by a reaction between the prepolymer and the hydrophilic polymer material to form pores in the prepolymer.

In an embodiment of the present disclosure, the prepolymer includes a polyisocyanate and is used to prepare urethane foam to form a matrix of the polishing pad. For example, the urethane may be prepared by a reaction between an isocyanate and an isocyanate-terminated polyurethane prepolymer from a prepolymer polyol. The polyol may include a polypropylene ether glycol, copolymers thereof, or mixtures thereof, but may not be limited thereto. To be specific, the reaction may be carried out by reacting a urethane prepolymer such as an isocyanate, a di-isocyanate, and a tri-isocyanate prepolymers with a prepolymer containing isocyanate reactive residue group. The suitable isocyanate reactive residue group may include an amine or polyol, but may not be limited thereto.

The polyisocyanate component is not particularly limited as long as it is an organic compound including two or more isocyanate groups in its one molecule. For example, the polyisocyanate may include aliphatic, alicyclic, or aromatic polyisocyanates or modified compounds thereof. To be specific, the aliphatic and alicyclic polyisocyanates may include hexamethylene diisocyanate, isophorone diisocyanate, and the like, but may not be limited thereto. The aromatic polyisocyanates may include tolylene diisocyanate, diphenyl methane diisocyanate, polyphenylene polymethylene polyisocyanate, or modified compounds thereof such as carbodiimide-modified compounds or prepolymers, but may not be limited thereto.

In an embodiment of the present disclosure, the above-described polymer resins may be used during a process of preparing the polishing pad of the present disclosure. In the preparing process, a synthesizing method widely known in the art may be used without a specific limitation. For example, if a main body of the pad is prepared from a polyurethane-based compound, a pre-polymer method or a one-shot method may be used. According to the pre-polymer method, a urethane prepolymer is formed by reacting a polyol component and an isocyanate component and then, the urethane prepolymer, a diamine or diol, a foaming agent, and a catalyst are mixed and cured, so that a polyurethane-based resin can be formed. Further, according to the one-shot method, a polyol component, an isocyanate component, a diamine or a diol, a foaming agent, and a catalyst are mixed and cured, so that a polyurethane-based resin can be formed.

In an embodiment of the present disclosure, the hydrophilic polymer material may include polyvinyl alcohol, polyethylene glycol, polyvinyl acetate, polyacrylic acid, polyethylene oxide, or isoprene sulfonate, but may not be limited thereto.

In an embodiment of the present disclosure, the hydrophilic polymer material is a polymer material including a hydrophilic group. The hydrophilic group may include an alcohol group, but may not be limited thereto. The hydrophilic polymer material including a hydrophilic group absorbs and contains moisture, so as to supply the moisture to a prepolymer when added to the prepolymer.

In an embodiment of the present disclosure, the hydrophilic polymer may be in the form of powder, but may not be limited thereto. If polyvinyl alcohol, polyethylene glycol, polyvinyl acetate, polyacrylic acid, polyethylene oxide, or isoprene sulfonate is added as the hydrophilic polymer to the prepolymer, stirring may be performed to improve dispersibility. By uniformly dispersing the hydrophilic polymer, a uniform pore distribution in the pad can be achieved. The polyvinyl alcohol powder particles range in size from about 1 μm to about 150 μm, but may not be limited thereto.

In an embodiment of the present disclosure, specifically, the hydrophilic powder particles may range in size from about 1 μm to about 150 μm, but may not be limited thereto.

The hydrophilic polymer of the present disclosure is used to form pores in the prepolymer. When the hydrophilic polymer is mixed with the prepolymer, moisture contained in the hydrophilic polymer reacts with a functional group in the prepolymer to generate carbon dioxide so as to form pores in the pad. However, the present disclosure may not he limited thereto.

Further, in addition to the polymer resin and the hydrophilic polymer, additives and adjuvants may be used as being mixed with the polymer resin, e.g., polyisocyanate component, depending on a use. The additives and adjuvants are not particularly limited. Any additive and adjuvant may be used as long as it is used to improve properties or processibility of a conventional resin but does not have a noticeable adverse influence on an urethanization reaction.

In an embodiment of the present disclosure, the hydrophilic polymer may contain moisture. The hydrophilic polymer containing moisture may contain moisture content of from about 0.05% to about 10% which is achieved by keeping the hydrophilic polymer powder including moisture in the amount of from about 0.01% to about 10% under an atmosphere having a humidity of from about 1% to about 50% for from about 1 hour to about 48 hours, but may not be limited thereto.

In an embodiment of the present disclosure, the hydrophilic polymer may have a moisture content of from about 0.05% to about 10%, from about 0.1% to about 10%, from about 0.2% to about 10%, from about 0.4% to about 10%, from about 0.6% to about 10%, from about 0.05% to about 8%, from about 0.05% to about 5%, or from about 0.05% to about 4%, but may not be limited thereto.

The moisture reacts with isocyanate of the prepolymer to generate carbon dioxide as shown in the following Reaction Formula 1. The generated carbon dioxide forms gas bubbles in the prepolymer. If the prepolymer is cured before the gas bubbles burst, closed pores may remain in the prepolymer. According to the method of preparing a porous polishing pad in accordance with an embodiment of the present disclosure, if the hydrophilic polymer is added to form pores in the pad, the hydrophilic polymer material is removed by slurry or distilled water. Therefore, the prepared polishing pad has a decreased surface roughness and a polishing surface with less scratches for a semiconductor substrate can be provided.

[Reaction Formula 1]

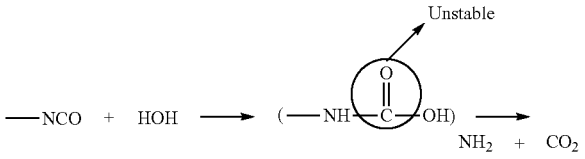

To be specific, referring to Reaction Formula 1, water (HOH) contained in polyvinyl alcohol and an isocyanate group (—NCO) react with each other, so that an unstable carboxyl group is produced and then immediately decomposed to $NH_2$ and $CO_2$. In this case, the generated carbon dioxide form gas bubbles in the prepolymer. If the prepolymer is cured in this state, the gas bubbles become pores of the polishing pad.

In an embodiment of the present disclosure, the method of preparing a polishing pad may include: adding a curing agent during the reaction between the prepolymer and the hydrophilic polymer, but may not he limited thereto.

In an embodiment of the present disclosure, the curing agent may include compounds used to cure or harden a urethane prepolymer, or mixtures of the compounds. The curing agent reacts with an isocyanate group to connect chains of the prepolymer and thus to form polyurethane. Generally used curing agents may include: 4,4'-methylene-bis(2-chloroaniline), which is abbreviated as MBCA and often called "MOCA" (registered trademark); 4,4'-methlene-bis(3-chloro-2,6-diethylaniline), which is abbreviated as MCDEA; dimethyl thiotoluenediamine; trimethylene glycol di-p-aminobenzoate; polytetramethylene oxide di-p-aminobenzoate; polytetramethylene oxide mono-p-aminobenzoate; polypropylene oxide di-p-aminobenzoate; polypropylene oxide mono-p-aminobenzoate; 1,2-bis(2-aminophenylthio)ethane; 4,4'-methylene-bis-aniline; diethyltoluenediamine; 5-tert-butyl-2,4- and 3-tert-butyl-2,6-toluenediamine; 5-tert-amyl-2,4-toluenediamine; 3-tert-amyl-2,6-toluenediamine or chlorotoluenediamine, but may not be limited thereto.

In accordance with a second aspect of the present disclosure, there is provided a porous polishing pad including carbon dioxide pores and being prepared according to the first aspect of the present disclosure.

In the second aspect of the present disclosure, the descriptions that can be applied in the same manner as described in the first aspect will be omitted to avoid redundancy and the descriptions of the first aspect of the present disclosure may be applied.

In an embodiment of the present disclosure, if carbon dioxide is generated by the reaction between the prepolymer and the hydrophilic polymer material according to the first aspect of the present disclosure, the reaction between the prepolymer and the hydrophilic polymer material can be controlled by regulating a temperature of the reaction, a stirring speed, a stirring time, and the like to regulate generation of the carbon dioxide. Therefore, it is possible to easily control a pore site and porosity of the porous polishing pad. According to a conventional method of preparing for forming pores in a polishing pad, it is difficult to precisely control a pore site and porosity and it is not easy to form pores having a uniform site of about 50 μm or less.

However, the polishing pad in the second aspect includes carbon dioxide pores, and desirably, the pores may range in size from about 1 μm to about 200 μm, but may not be limited thereto. Further, the polishing pad in the second aspect as prepared according to the first aspect of the present disclosure includes carbon dioxide pores, and desirably, the pores may provide porosity from about 1% to about 60%, but may not be limited thereto.

Furthermore, in a conventional polishing pad, a physical foaming agent used for forming pores remains on the pad after completion of the pad to cause a defect in a polishing target during a polishing process. However, in the polishing pad in the second aspect, impurities are not generated from a foaming agent, and, thus, generation of defects can be prevented. The hydrophilic polymer material used for forming carbon dioxide pores in the method of preparing the present disclosure is dissolved in a slurry or distilled water and then removed during a chemical mechanical polishing process. Therefore, the hydrophilic polymer material may not affect a polishing target.

Hereinafter, the present disclosure will be described in more detail with reference to examples. The following examples are provided only for explanation, but do not intend to limit the scope of the present disclosure.

Example 1

A prepolymer was prepared and heated to from 50° C. to 80° C., and then mixed with polyvinyl alcohol in the form of powder having a particle size of from 10 μm to 100 μm. The polyvinyl alcohol acted to absorb moisture. The polyvinyl alcohol was prepared to have a moisture content of from 0.05% to 10% by keeping polyvinyl alcohol powder containing moisture in the amount of from 0.01% to 10% under an atmosphere having a humidity of from 1% to 50% for from 1 hour to 48 hours. The mixture of the prepolymer and the polyvinyl alcohol was placed in an oven at 125° C. While heating the mixture, molten 4,4'-methylene-bis(2-chloroaniline) as a curing agent was injected, and then, stirring was performed for 30 seconds. During the stirring process, the moisture contained in the polyvinyl alcohol was reacted with isocyanate from the prepolymer to generate carbon dioxide in the prepolymer, so that pores were formed in a urethane resin. After the stirring, the resin was coated on a plate or regular template with little step difference. Herein, the plate or template was heated in an oven at 100° C. for 1 hour or more and then used. The plate or template coated with the resin was placed in the oven at 100° C. and cured for 24 hours or more. After the curing, urethane was separated from the template and then cut to a thickness of from 1 mm to 3 mm.

In order to compare polishing performance between the polishing pad prepared according to Example 1 with a conventional polishing pad, a commercially available polishing pad formed of a polyurethane matrix in which spherical pores are filled was used as the conventional polishing pad to polish a silicon wafer. The composition for a surface layer of the silicon wafer as a polishing target was silicon dioxide. The wafer was polished on commercially available wafer polishing machine (AP-300) using a commercially available silica-based polishing slurry and a diamond pad conditioner combined as a part of the polishing machine. The pad was conditioned for 15 minutes before polishing each wafer.

The conditioning process was performed to form a series of irregularly arranged micro cracks or grooves on a surface of the pad. Through the conditioning process, a series of grooves having a pitch of 0.085 inch and a depth of 0.040 inch were formed on the pad. Further, the polishing was performed under the conditions including a pressure of 9 psi, a press plate speed of 95 rpm, a carrier speed of 90 rpm, and a polishing time of 1 minute. These conditions were equally applied to the present experimental example and the other experimental examples to directly compare the performance of the polishing pad according to the method of preparing the present disclosure with the performance of the conventional polishing pad. In case of using the conventional polishing pad, when a polishing process was performed under the above-described polishing conditions, a material removal rate in a test wafer was 2000 Å/min or less. However, in case of using the polishing pad according to the method of preparing Example, a high and uniform polishing rate of 3,000 Å/min or less was observed and the non-uniformity of a material removal rate in the entire wafer was very low.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

We claim:

1. A method of preparing a porous polishing pad, comprising:

dispersing a hydrophilic polymer material in powder form containing absorbed moisture, in an isocyanate-containing prepolymer; and generating carbon dioxide by a reaction between the isocyanate groups of said prepolymer and the moisture in said hydrophilic polymer material to form pores in the prepolymer, wherein said hydrophilic polymer powder has a moisture content of from about 0.2 wt% to about 10 wt%, wherein the moisture content is achieved by keeping the hydrophilic polymer powder under an atmosphere having a humidity of about 1% to about 50% for about 1 to about 48 hours, and wherein particles of said hydrophilic polymer powder range in size from about 1 μm to about 150 μm.

2. The method of preparing a porous polishing pad of claim 1, wherein the hydrophilic polymer material is selected from the group consisting of polyvinyl alcohol, polyethylene glycol, polyvinyl acetate, polyacrylic acid, polyethylene oxide, isoprene sulfonate, and mixtures thereof.

3. The method of preparing a porous polishing pad of claim 1, wherein a curing agent is added during the reaction between the prepolymer and the hydrophilic polymer.

4. The method of preparing a porous polishing pad of claim 3, wherein the curing agent is selected from the group consisting of 4,4'-methylene-bis(2-chloroaniline); 4,4'-methylene-bis(3-chloro-2,6-diethylaniline); dimethyl thiotoluenediamine; trimethylene glycol di-p-aminobenzoate; polytetramethylene oxide di-p-aminobenzoate; polytetramethylene oxide mono-p-aminobenzoate; polypropylene oxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4-toluenediamine; 3-tert-butyl-2,6-toluenediamine; 5-tert-amyl-2,4- toluenediamine; 3-tert-amyl-2,6-toluenediamine; chlorotoluenediamine; and mixtures thereof.

5. The method of claim 1, wherein the hydrophilic polymer powder particle size ranges from about 10 μm to about 100 μm.

6. The method of claim 1, wherein said hydrated hydrophilic polymer is uniformly dispersed in said isocyanate-containing prepolymer.

7. The method of claim 6, wherein a uniform distribution of pores ranging in size from about 1 μm to about 200 μm is produced by controlling the temperature, stirring speed and stirring time of the process.

8. The method of claim 1, wherein said moisture content is about 0.4 wt% to about 10 wt%.

9. The method of claim 1, wherein said moisture content is about 0.6 wt% to about 10 wt%.

* * * * *